US005368813A

United States Patent [19]

Hobbs et al.

[11] Patent Number: 5,368,813

[45] Date of Patent: Nov. 29, 1994

[54] OXIDATION AND SULFIDATION RESISTANT CHROMIUM-NIOBIUM ALLOY

[75] Inventors: Linn W. Hobbs, Belmont; Chuxin Zhou, Lexington; Julia C. Duncan, Somerville, all of Mass.

[73] Assignee: Massachusetts Institute of Technology, a MA Corp., Cambridge, Mass.

[21] Appl. No.: 65,437

[22] Filed: May 24, 1993

[51] Int. Cl.[5] ..... B32B 15/00

[52] U.S. Cl. ..... 420/425; 148/281; 420/428; 428/660; 428/662

[58] Field of Search ..... 148/281; 420/425, 428; 428/660, 662

[56] References Cited

U.S. PATENT DOCUMENTS

| | | | |
|---|---|---|---|
| 3,503,792 | 3/1970 | Baginski et al. | 117/135.1 |
| 4,470,848 | 9/1984 | Natesan et al. | 420/419 |
| 4,836,849 | 6/1989 | Svedberg et al. | 75/245 |
| 5,032,469 | 7/1991 | Merz et al. | 427/455 |
| 5,164,270 | 11/1992 | Natesan | 428/660 |

FOREIGN PATENT DOCUMENTS

| | | |
|---|---|---|
| 55-048580 | 12/1980 | Japan . |
| 63-014835 | 1/1988 | Japan . |
| 530915 | 12/1976 | U.S.S.R. . |

OTHER PUBLICATIONS

"Simultaneous Oxidation and Sulfidation Protection Using Refractory Metal Alloys", Zhou et al., p. 55, 1992, *3rd International Symposium on High Temperature Corrosion and Protection of Materials Abstracts, France, 1992.*

"Effect of Nb on the High-Temperature Sulfidation Behavior of Cobalt", Gleeson et al., pp. 209-236, 1989, Oxidation of Metals, 31.

"High-Temperature Sulfidation Behavior of Ni-Nb Alloys", Chen et al., pp. 237-263, 1989, Oxidation of Metals, 31.

"High-Temperature Sulfidation of Fe-Nb Alloys", Wang et al., pp. 273-294, 1989, Oxidation of Metals, 32.

"The Effect of Chronium and Vanadium on Resistance of Niobium to Oxidation", Fedotov, pp. 248-252, 1979, Izvestiya Akademii Nauk SSSR Metallurgia, 5.

"Microstructure and mechanical properties of Laves--phase alloys based on $Cr_2Nb$", M. Takeyama and C. T. Liu, pp. 61-66, 1991, Materials Science and Engineering, A132.

*High Temperature Corrosion,* Per Kofstad, Elsevier Applied Science, London, p. 429, 1988.

"The kinetics of sulphidation of niobium", N. Strafford and J. R. Bird, pp. 223-228, 1969, Journal of the Less--Common Metals, 68.

*Metals Handbook,* 8th Edition, Taylor Lyman et al., p. 281, 1973, American Society for Metals, Metals Park, Ohio.

"Kinetics and Mechanism of the Sulfidation of Fe-Mo Alloys", R. V. Carter, pp. 341-367, 1989, Oxidation of Metals, 31.

*Primary Examiner*—Upendra Roy

*Attorney, Agent, or Firm*—Florence Fusco McCann

[57] ABSTRACT

Oxidation and sulfidation resistant alloys and mixtures including chromium and niobium as well as oxidation and sulfidation resistant articles including chromium and niobium present as either an alloy or a mixture are provided. A method for preparing an oxidation and sulfidation resistant article by preparing a material including chromium and niobium and either forming an article directly from the chromium and niobium containing material or forming the article from a base material and coating the material with a coating including a chromium and niobium-containing material is provided.

10 Claims, 9 Drawing Sheets

OXIDATION AND SULFIDATION RESISTANT CHROMIUM-NIOBIUM ALLOY

The United States government has rights in this invention based on grants DMR87-13689 and DMR90-22640 from the National Science Foundation.

BACKGROUND OF THE INVENTION

1. Field of the Invention

The invention relates to an oxidation and sulfidation resistant chromium-niobium containing alloy, a mixture containing chromium and niobium and a chromium and niobium-containing article as well as to a method for improving the oxidation and sulfidation resistance of an article using a chromium and niobium-containing material.

2. Description of the Prior Art

It is well known that structural base metals such as iron (Fe), cobalt (Co) and nickel (Ni) are neither oxidation nor sulfidation resistant when exposed to oxidizing or sulfidizing environments at high temperatures. It is also well-established that the foregoing metals undergo sulfidation at rates orders of magnitude greater than the rates at which they undergo oxidation under comparable sulfur partial pressure and temperature conditions as reported by Kofstad, *High Temperature Corrosion,* Elsevier, London (1988), p. 429.

The pure element chromium (Cr) and chromium-containing alloys display high temperature oxidation resistance due in part to the formation of a $Cr_2O_3$ scale, which allows only very slow diffusion of the reactant species involved in the oxidation process through the scale, even at high temperatures, thereby inhibiting the oxidative corrosion process. Niobium and its alloys exhibit poor oxidation resistance at high temperatures.

Pure, elemental niobium (Nb), known also as columbium (Cb), is known to display high temperature sulfidation resistance, analogous to the oxidation resistance of chromium and chromium-containing alloys, due in part to the formation of a passivating scale which can include a $NbS_2$ scale as described in Strafford and Bird, "The Kinetics of Sulphidation of Niobium", J. Less-Common Metals, 68, (1979), 223. Attempts to capitalize on the sulfidation resistance of Nb by incorporating this element as an alloying addition to other base metals as described in Gleeson et al., "Effect of Nb on the High-Temperature Sulfidation Behavior of Cobalt", Oxidation of Metals, 31, (1989), 209–236; Chen et al., "High-Temperature Sulfidation Behavior of Ni-Nb Alloys", Oxidation of Metals, 31, (1989), 237–263 and Wang et al., "High-Temperature Sulfidation of Fe-Nb Alloys", Oxidation of Metals, 32, (1989), 273–294 have not resulted in alloys exhibiting acceptable sulfidation resistance. Additions of up to 40 wt. % Nb failed to form a continuous $NbS_2$ protective layer in Ni, Co and Fe binary alloys. Further additions of molybdenum to form a ternary alloy improved sulfidation resistance only slightly.

Chromium and conventional chromium-containing alloys sulfidize catastrophically in the presence of sulfur. Even pre-oxidized chromium and chromium alloys having a $Cr_2O_3$ scale are rapidly degraded by low sulfur levels present in $H_2$-$H_2O$-$H_2S$ gas mixtures where oxygen partial pressure is of the order of $10^{-10}$ atm and sulfur partial pressure is of the order of $10^{-6.5}$ atm as observed for a Fe-45 wt. % Cr alloy at 1173K.

Environments are frequently encountered, particularly in energy conversion system applications involving fuel-fired steam burners, coal-fired gas turbines, coal gasification and liquefaction and fuel gas desulfurization, as well as in the petrochemical industries, where both oxygen and sulfur are present at high temperatures. Materials used in such applications can be exposed to sharp variations in oxygen and sulfur concentration and can be exposed to gas mixtures containing both oxygen and sulfur as well as to gas mixtures which are either extremely oxidizing or extremely sulfidizing. Typical oxygen contents can be in the range of from about $1\times10^{-10}$ atm to about $1\times10^{-20}$ atm and typical sulfur contents can be in the range of from about $1\times10^{-7}$ atm to about $1\times10^{-10}$ atm. These harsh environments demand materials which can withstand extreme oxidizing conditions, extreme sulfidizing conditions as well as conditions which are simultaneously oxidizing and sulfidizing at high temperatures.

Thus, there exists a need for materials which exhibit oxidation resistance, sulfidation resistance as well as combined oxidation and sulfidation resistance at elevated temperatures and for a method for improving the oxidation resistance, sulfidation resistance and combined oxidation and sulfidation of articles at high temperatures.

SUMMARY OF THE INVENTION

The invention provides an alloy including chromium and niobium which is characterized by oxidation resistance, sulfidation resistance and combined oxidation and sulfidation resistance.

In another aspect of the invention, a mixture including chromium and niobium and characterized by oxidation resistance and sulfidation resistance and combined oxidation and sulfidation resistance is also provided.

In another aspect of the invention, an article including an alloy comprising chromium and niobium and characterized by oxidation resistance, sulfidation resistance as well as combined oxidation and sulfidation resistance is also provided.

In yet another aspect of the invention, a method for preparing an article characterized by oxidation, sulfidation and combined oxidation and sulfidation resistance is provided. The method includes steps of (1) preparing a material, such as an alloy or mixture, including chromium and niobium which is characterized by the required oxidation, sulfidation and combined oxidation and sulfidation resistance and (2) forming the desired article from the oxidation and sulfidation resistant material including chromium and niobium.

Objects of this invention include providing an alloy, mixture and article characterized by resistance to oxidation, sulfidation and combined oxidation and sulfidation and, therefore, capable of withstanding exposure to atmospheres containing mixtures of oxygen and sulfur at high temperatures including extremely oxidizing and extremely sulfidizing atmospheres.

A further object of the invention is provision of a method for preparing an oxidation and sulfidation resistant article by preparing an oxidation and sulfidation resistant material including both chromium and niobium and forming the article from the oxidation and sulfidation resistant chromium and niobium containing material.

Other and further objects, features and advantages of the present invention will be readily apparent to those skilled in the art in reading the description of the preferred embodiments which follows.

BRIEF DESCRIPTION OF THE DRAWINGS

FIG. 9 is an x-ray diffraction profile obtained from a chromium-40 wt. % niobium sample oxidized in air for 20 hours at 1173K.

DETAILED DESCRIPTION OF THE INVENTION

Figure 1:
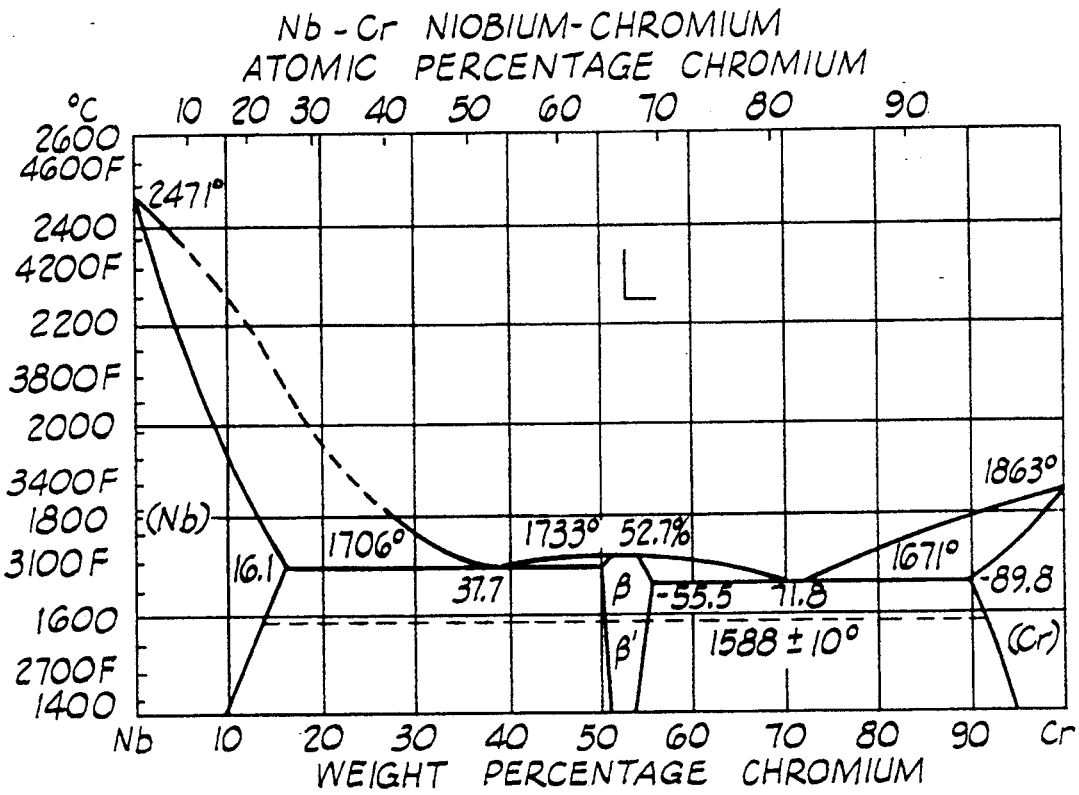
FIG. 1 is a constitution-temperature phase diagram of the chromium-niobium system.

The invention provides an alloy including chromium and niobium which is characterized by resistance to both sulfidation and oxidation in atmospheres including both oxygen and sulfur as well as under extremely oxidizing and sulfidizing conditions. A mixture including chromium and niobium and characterized by resistance to both oxidation and sulfidation is also provided as are articles made of an alloy including chromium and niobium which are characterized by oxidation and sulfidation resistance. Finally, a method is provided for preparing an oxidation and sulfidation resistant article by preparing an alloy including chromium and niobium characterized by both oxidation and sulfidation resistance and forming the desired article from the oxidation and sulfidation resistant alloy.

In this specification and claims, the term "oxidation resistance" refers to corrosion behavior in an oxygen-containing atmosphere having an oxygen concentration in the range of from about $10^{-22}$ atm to about 1 atm characterized by parabolic corrosion kinetics. Such parabolic kinetics can be represented by a parabolic rate constant including parabolic rate constants less than about $10^{-8}$ $kg^2/m^4s$ at a temperature in the range of from about 973K. to about 1273K. The term "sulfidation resistance" refers to corrosion behavior in a sulfur-containing atmosphere having a sulfur concentration in the range of from about $10^{-7}$ atm to about 1 atm characterized by parabolic corrosion kinetics. Such parabolic kinetics can be represented by parabolic rate constants including parabolic rate constants less than about $10^{-6}$ $kg^2/m^4s$ at temperatures below about 1173K.

The chromium-niobium sulfidation and oxidation resistant alloy of the invention contains an amount of chromium sufficient to form a film which is protective against further oxidation and which can be a continuous $Cr_2O_3$ scale when the alloy is exposed to an oxygen-containing atmosphere, including a highly oxidizing atmosphere, combined with an amount of niobium sufficient to form a film which is protective against sulfidation and which can be continuous niobium-containing scales such as $NbS_2$, $NbO_2$ and mixtures thereof when the alloy is exposed to a sulfur and/or oxygen-containing atmosphere, including a highly sulfidizing atmosphere.

The chromium oxide and niobium-containing protective scales can be formed sequentially or simultaneously. The $Cr_2O_3$ and niobium-containing scales such as $NbS_2$, $NbO_2$ and mixtures thereof can be formed on the alloy sequentially by first subjecting the alloy to oxidation and then exposing the pre-oxidized alloy to a sulfur-containing atmosphere.

The chromium and niobium-containing alloy can withstand exposure to extremely oxidizing conditions with an oxygen concentration in the range of from substantially pure oxygen at 1 atm to about air at 1 atm, as well as to extremely sulfidizing conditions with a sulfur concentration of about pure sulfur gas at 1 atm. In mixtures containing both oxygen and sulfur gas, oxygen concentration can be in the range of from about $1\times10^{-10}$ atm to about $1\times10^{-21}$ atm and sulfur concentrations can be in the range of from about 1 atm to about $1\times10^{-10}$ more preferably in the range of from about $1\times10^{-5}$ atm to about $1\times10^{-10}$ atm and most preferably in the range of from about $1\times10^{-8}$ atm to about $1\times10^{-10}$ atm. Typical temperatures of the oxygen and sulfur-containing atmospheres to which the alloy can withstand exposure are in the range of from about 1073K. to about 1173K.

Typical oxidation and sulfidation resistant alloy compositions are characterized by a chromium concentration in the range of from about 17 wt. % to about 72 wt. %, and more preferably in the range of from about 38 wt. % to about 60 wt. %, and by niobium concentrations in the range of from about 28 wt. % to about 83 wt. %, and more preferably in the range of from about 40 wt. % to about 62 wt. %. Other suitable alloy compositions include compositions bounded by the eutectic compositions on either side of the $\beta$ and $\beta'$ phase field.

For example, the oxidation and sulfidation resistant chromium-niobium alloy can be a binary alloy having a composition 40 wt. % niobium and 60 wt. % chromium and which can include about 90 wt. % of a first, ordered $\beta'$ $Cr_2Nb$ phase and up to about 10 wt. % of a second, body-centered cubic chromium with about 5 wt. % niobium in solution phase or binary alloys having a composition near that of the ordered $\beta'$ $Cr_2Nb$ composition, preferably in the range of from about 40 wt. % to about 83 wt. % niobium and more preferably in the range of from about 40 wt. % to about 62 wt. % niobium.

The sulfidation and oxidation resistant chromium-niobium containing alloy can be a ternary alloy containing sufficient Cr to form a chromium-containing protective scale such as $Cr_2O_3$ which can be continuous under oxidizing conditions and sufficient Nb to form a niobium-containing protective scale which can be continuous and which can include $NbS_2$ under sulfidizing conditions. The term "sulfidizing conditions" as used herein in the specification and claims refers to conditions under which a sulfide compound can be formed.

According to another preferred embodiment of the invention, an oxidation, sulfidation and combined oxidation and sulfidation resistant mixture including chromium and niobium constituents in sufficient quantities, respectively, to form a protective chromium-containing scale such as $Cr_2O_3$ which can be continuous when the mixture is exposed to an oxygen-containing atmosphere and a protective niobium-containing scale which can be continuous and can include $NbS_2$, $NbO_2$ and mixtures thereof when the mixture is exposed to a sulfur- and/or oxygen-containing atmosphere is provided. Such a mixture can be produced when discrete grains of the elemental constituents of the alloy are retained in a plasma spraying process, for example.

The oxidation and sulfidation resistant niobium- and chromium-containing mixture can be prepared by combining chromium powder and niobium powder using powder processing techniques well known to one skilled in the art and including such processing techniques as spray atomization. Preferred chromium and niobium powders are characterized by a particle size which corresponds to a grain size which is sufficiently small to enable overgrowth of a protective scale.

A preferred oxidation and sulfidation resistant article of the invention includes a chromium-niobium alloy wherein the alloy is characterized by a chromium concentration in the range of from about 17 wt. % to about 72 wt. % and more preferably in the range of from about 38 wt. % about 60 wt. %, and a niobium concentration in the range of from about 28 wt. % to about 83 wt. % and more preferably in the range of from about 40 wt. % to about 62 wt. %.

According to a preferred embodiment, an article is composed of a binary alloy having a composition of 40 wt. % niobium and 60 wt. % chromium. Depending upon the desired mechanical properties of the oxidation and sulfidation resistant article, the article can either be constructed entirely of a chromium and niobium-containing material such as an alloy or mixture or can be formed from a different base material upon which an oxidation and sulfidation resistant coating, including chromium and niobium, is deposited. Over a temperature range of from about 298K. to about 1073K., chromium and niobium-containing alloys including the preferred chromium-40 wt. % niobium alloy are typically mechanically brittle and articles designed for service in this temperature range in oxidizing and/or sulfidizing atmospheres can be prepared by coating a more mechanically robust, although less sulfidation and oxidation resistant, base material with a coating containing an oxidation and/or sulfidation resistant material including chromium and niobium. At high temperatures, in the range of from about 1073–K-1473K., chromium and niobium-containing alloys having substantial concentrations of the brittle intermetallic phase, $Cr_2Nb$ become more ductile and have more acceptable mechanical properties such as 0.2% strain-offset stresses greater than 800 MPa and ductility exceeding 20–25% compressive strains.

According to a preferred method for preparing an oxidation and sulfidation resistant article, an alloy including chromium and niobium, characterized by oxidation and sulfidation resistance, is prepared by any technique known to one skilled in the art for preparation of an alloy including co-melting and solidification and mixing together of a chromium-containing powder and a niobium-containing powder using an alloying technique to form the desired Cr-Nb containing alloy. Suitable alloying techniques include ball milling, consolidating and hot isostatic pressing, explosive bonding, cold pressing and sintering, hot pressing, hot rolling, or hot extruding.

The article can be formed from the alloy prepared according to any of the foregoing techniques by directly shaping the chromium and niobium containing alloy into the shape of the article or by shaping a base metal to form a base metal shape and coating the base metal shape with the alloy to form the oxidation and sulfidation resistant article, depending upon the desired mechanical properties of the article. As previously stated, chromium and niobium-containing alloys are typically mechanically brittle except at high temperatures, in the range of from about 1073K. to about 1473K., where chromium and niobium-containing alloys such as chromium-40 wt. % niobium become more ductile and exhibit acceptable mechanical properties. An oxidation and/or sulfidation resistant article can combine desired structural robustness of a selected base metal such as Fe- and Cr-containing alloys, Ni-Cr or Co-Cr containing alloys, Ni-Al containing alloys, Ni-Cr-Al or Co-Cr-Al containing alloys or Fe, Cr and Al-containing alloys combined with the oxidation and sulfidation resistance provided by the chromium and niobium-containing alloy coating. The base metal shape can be coated with the chromium and niobium-containing alloy using a coating technique such as chemical vapor deposition, physical vapor deposition, sputtering, diffusion coating, plasma spraying, electrochemical deposition or ion-beam assisted deposition, as known to one skilled in the art.

In order to further illustrate the present invention, the following examples are provided. The particular compounds, processes and conditions utilized in the examples are meant to be illustrative of the present invention and not limiting thereto.

EXAMPLE 1

The following example is provided to show how combining chromium and niobium produces an alloy exhibiting improved corrosion resistance when exposed to an extremely oxidizing atmosphere as well as to an extremely sulfidizing atmosphere by comparison with pure Cr, pure Nb and alloys such as Fe-45 wt. % Cr, and Fe-40 wt. % Mo.

Kinetic and microstructural studies of oxidation and sulfidation of a chromium-40 wt. % niobium alloy were performed at 1173K. in sulfur vapor ($P_{S2}$=0.74atm). The chromium-40 wt. % niobium alloy is a two phase alloy consisting of an fcc $Cr_2Nb$ intermetallic phase and a small amount of chromium-based alloy and shows very good oxidation resistance and appreciable sulfidation resistance by comparison with the above-mentioned conventional alloys. The dominant oxidation product is chromium oxide, and the sulfidation products are rhombohedral $Cr_2S_3$ external scale, and a niobium sulfide ($NbS_2$) inner scale intervening between the $Cr_2S_3$ and original alloy surface.

Finger-shaped Cr-40 wt. % Nb alloy ingots were prepared by Ames Laboratories, Ames, IA using a non-consumable electric arc melting technique in a high purity argon atmosphere. Nb and Cr were arc co-melted on water-cooled copper hearth plates in an atmosphere of ultra-high purity argon. Starting materials were 99.996% pure Cr and 99.97% pure Nb.

This alloy composition is located in a two phase region including a $Cr_2Nb$ intermetallic compound and Cr-based alloy, as shown in the phase diagram of FIG. 1 (after T. Lyman ed. *Metals Handbook,* 8th ed. "Metallography, Structures and Phase Diagrams", ASM, (1973) p. 281.) Each as-cast ingot was encapsulated in a quartz tube flushed with high purity argon, with Ta as an oxygen getterer and then annealed at 1373K. for 50 hours.

To prevent mechanical damage to the alloy samples during slicing, the samples were potted inside a steel tube with a five-minute epoxy resin; then each potted sample was sliced into disks of from about 0.5 mm to about 1 mm in thickness. Prior to exposure to reaction gas mixtures at high temperature, specimens were cleaned in acetone and methanol. The weight and size of each specimen were measured with an electronic balance and a micrometer, respectively, and its area was calculated. Specimens were then degreased in acetone and methanol or methanol only ultrasonically. After drying for 10 minutes to 30 minutes, the specimens were subjected to oxidation and sulfidation experiments.

Oxidation experiments were conducted at 1173K. in ambient atmosphere. Sulfidation experiments were carried out in sulfur vapor of known concentration generated from liquid sulfur.

Figure 2:
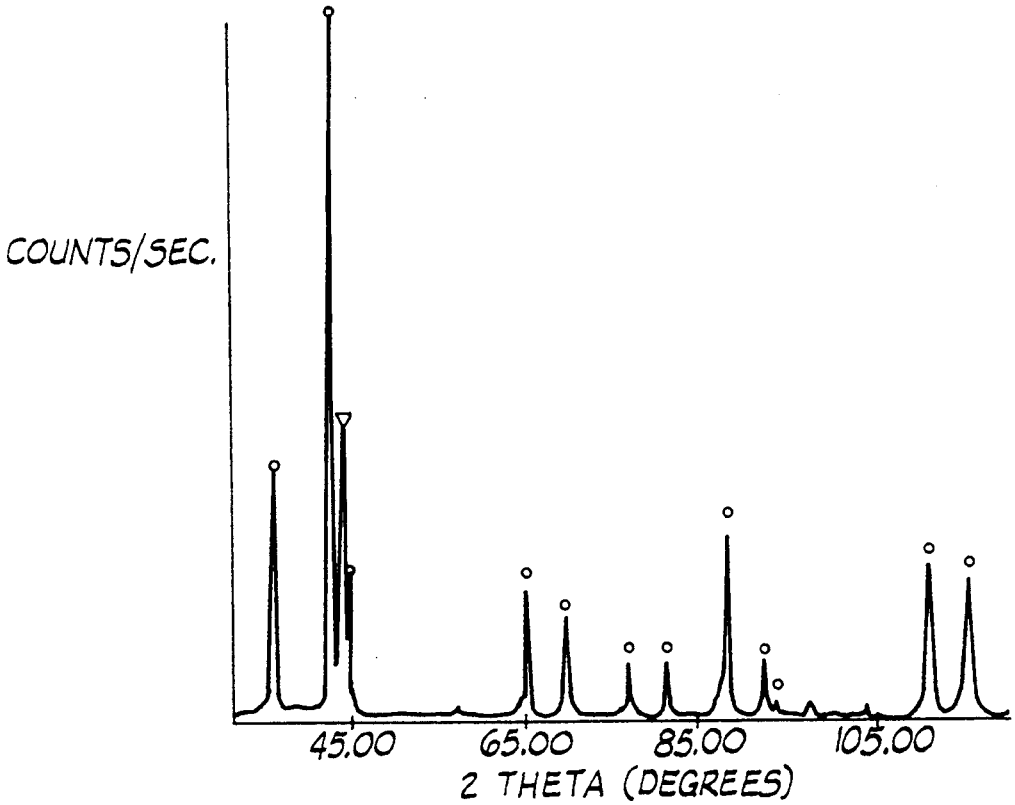
FIG. 2 is an x-ray diffraction spectrum of a chromium-40 wt. % niobium sample.
Figure 3:
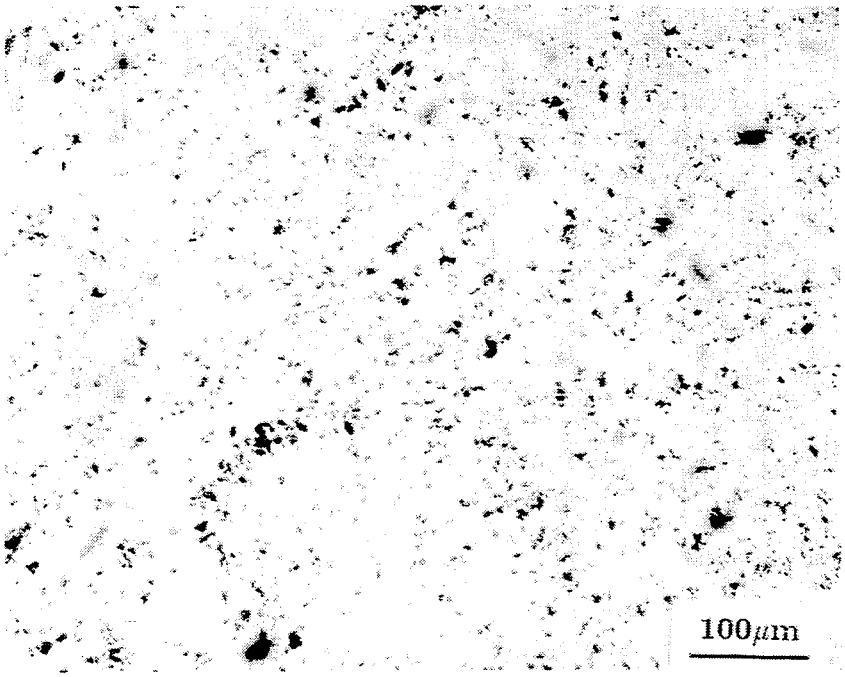
FIG. 3 is a reflected light micrograph of a polished surface of a chromium-40 wt. % niobium sample.
Figure 4:
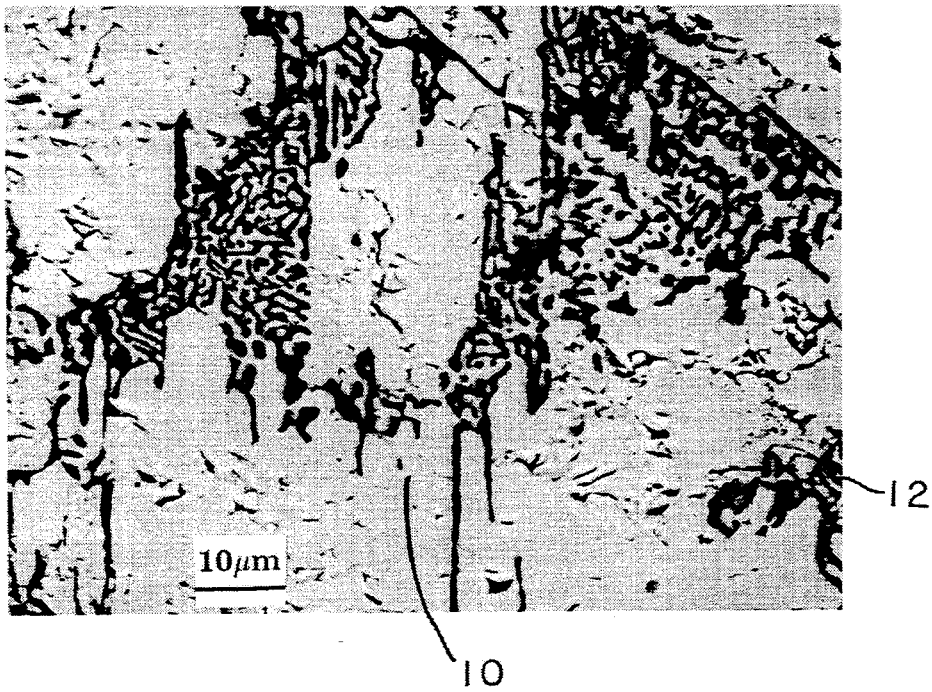
FIG. 4 is a SEM back-scattered electron image of a surface of a chromium-40 wt. % niobium sample.

Based on the phase diagram of the Cr-Nb binary system shown in FIG. 1, cooling a liquid of composition Cr-40Wt.%Nb, causes the solid intermetallic phase $Cr_2Nb$ to first appear at approximately 1973K.; $Cr_2Nb$ has a hexagonal structure ($P6_3/mmc$) above 1861±10K. and an fcc structure (Fd3m) below this temperature. The composition of the Cr-40 wt. % Nb alloy lies in a two phase region ($Cr+Cr_2Nb$) near to the intermetallic phase composition at 1173K., the temperature used for the corrosion studies. X-ray diffraction results shown in FIG. 2 show that the face-centered intermetallic cubic phase indicated by open circles predominates with minor peaks consistent with pure Cr indicated by v. The two-phase microstructure and extent of alloy inhomogeneity are shown in FIG. 3 and FIG. 4. In FIG. 4, light areas 10 correspond to the $Cr_2Nb$ phase and dark areas 12 correspond to the Cr solid solution (Cr-5wt % Nb).

TABLE 1

Figure 6:
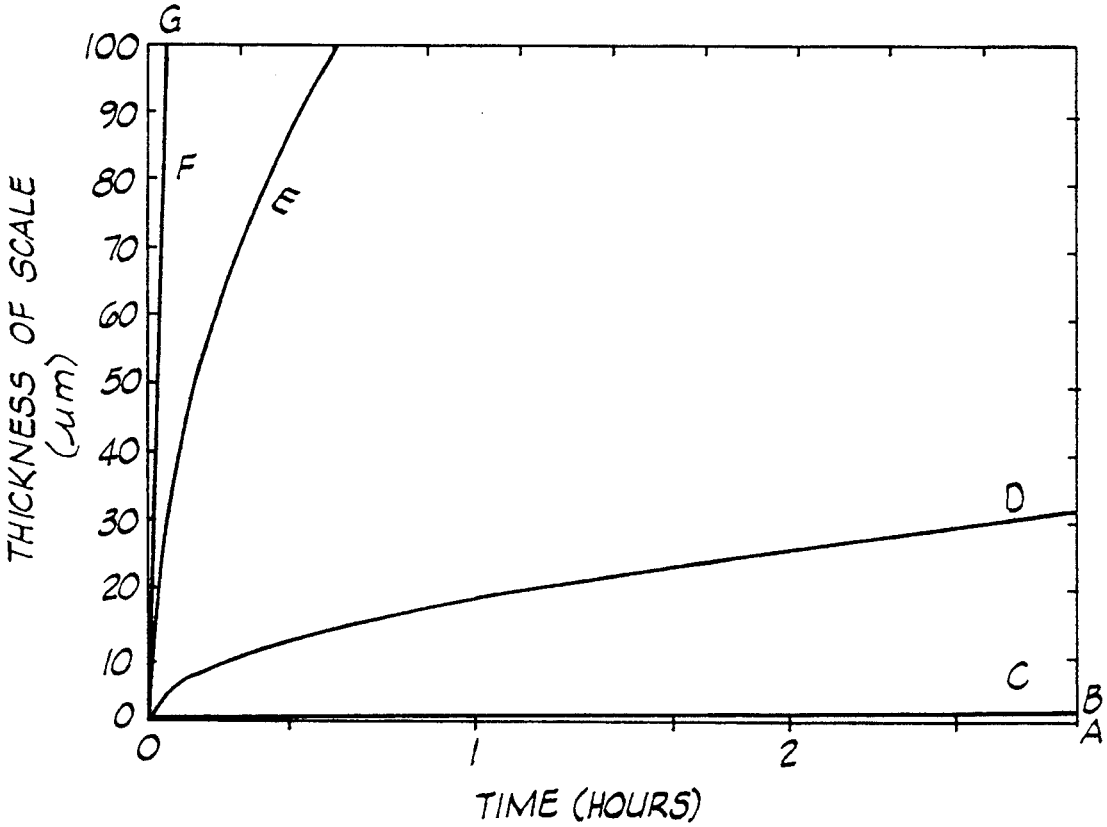
FIG. 6 is a graph showing scale thickness as a function of time indicating scale growth kinetics for oxidation of iron-45 wt. % chromium, chromium-40 wt. % niobium and niobium samples as well as for sulfidation of niobium, chromium-40 wt. % niobium, iron-40wt % molybdenum and for oxidation/sulfidation of iron-45 wt. % chromium samples.

Oxidation and sulfidation conditions for the kinetic curves shown in FIG. 6.

| Curve | Alloy | Reaction | Environment |
|---|---|---|---|
| A | Fe-45 wt. % Cr | oxidation | air |
| B | Cr-40 wt. % Nb | oxidation | air |
| C | Nb | sulfidation | $H_2$—$H_2S$ $P_{S2}$ = $10^{-9}$–$10^{-4.62}$ atm |
| D | Cr-40 wt. % Nb | sulfidation | sulfur vapor $P_{S2}$ = 0.74 atm |
| E | Fe-40 wt. % Mo | sulfidation | sulfur vapor $P_{S2}$ = $\sim 10^{-2}$ atm |
| F | Nb | oxidation | air |
| G | Fe-45 wt. % Cr | oxidation/ sulfidation | $H_2$—$H_2S$—$H_2O$ $P_{S2}$ = $10^{-6.5}$, $P_{O2}$ = $10^{-19}$ |

The Cr-40wt %Nb alloy showed oxidation resistance in air and sulfidation resistance at 1173K. including at the rather high sulfur pressure of $P_{S2}$ approximately equal to 0.74atm. The scaling rate was determined by an average scale thickness measurement using SEM cross-section observation.

Figure 5:
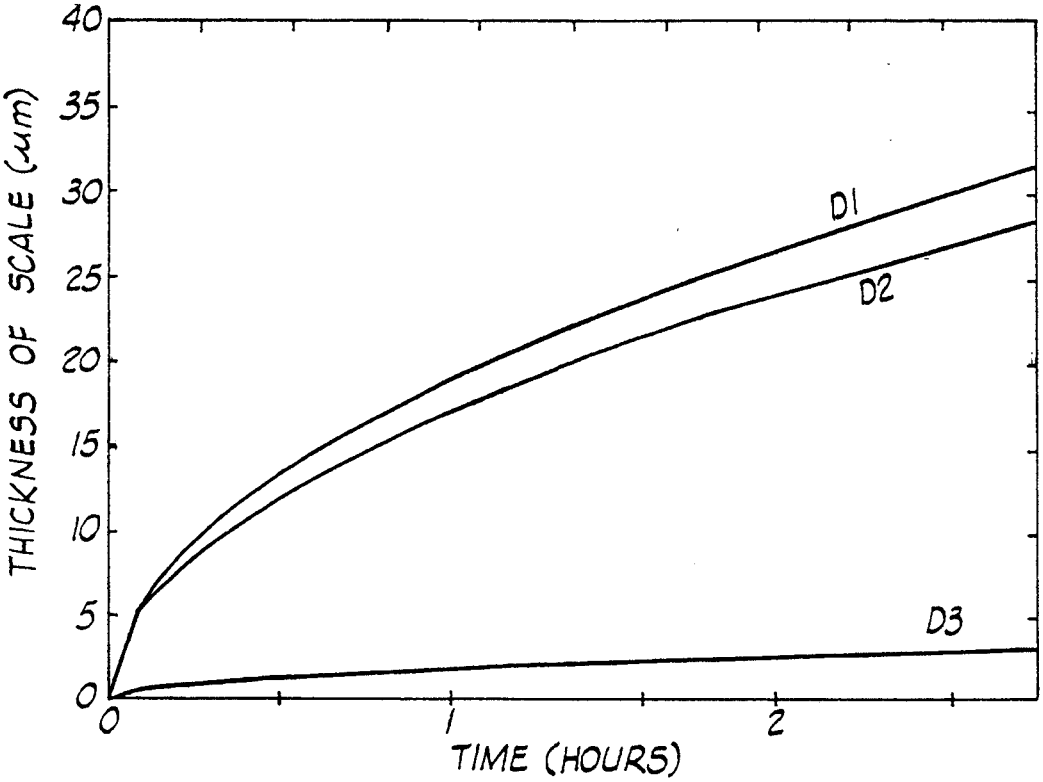
FIG. 5 is a graph of scale thickness as a function of time indicating scale growth kinetics for a chromium-40 wt. % niobium sample.

Both sulfidation and oxidation rates appear to follow a parabolic rate law as shown by the graphs in FIGS. 5 and 6. Sulfidation of this alloy resulted in a duplex scale. X-ray Energy Dispersive Spectroscopic (XEDS) examination indicated that the external scale was rich in Cr and S, while the inner scale was rich in Nb and S. Curves D1, D2, and D3 in FIG. 5 correspond to the thickness of the overall scale, external scale and inner scale, respectively; the error bars are approximately 10% due to the nonuniform development of the scale. In order to have a convenient comparison, oxidation and sulfidation scaling rates for oxidation of Fe-45 wt. % Cr (curve A), sulfidation of Nb (curve C), sulfidation of Fe-40 wt. % Mo (curve E) at 1173K. are all plotted in FIG. 6 with the data for the sulfidation of the Cr-Nb containing alloy (curve D) and oxidation/sulfidation of Fe-45 wt. % Cr (Curve G). The corresponding reaction conditions are given in Table 1. (The sulfidation scaling rate for Fe-40 wt. % Mo alloy was calculated from the data of Carter et al., "Kinetics and Mechanism of the Sulfidation of Fe-Mo Alloys", Oxidation of Metals, 31, (1989), 341–367.)

Figure 7:
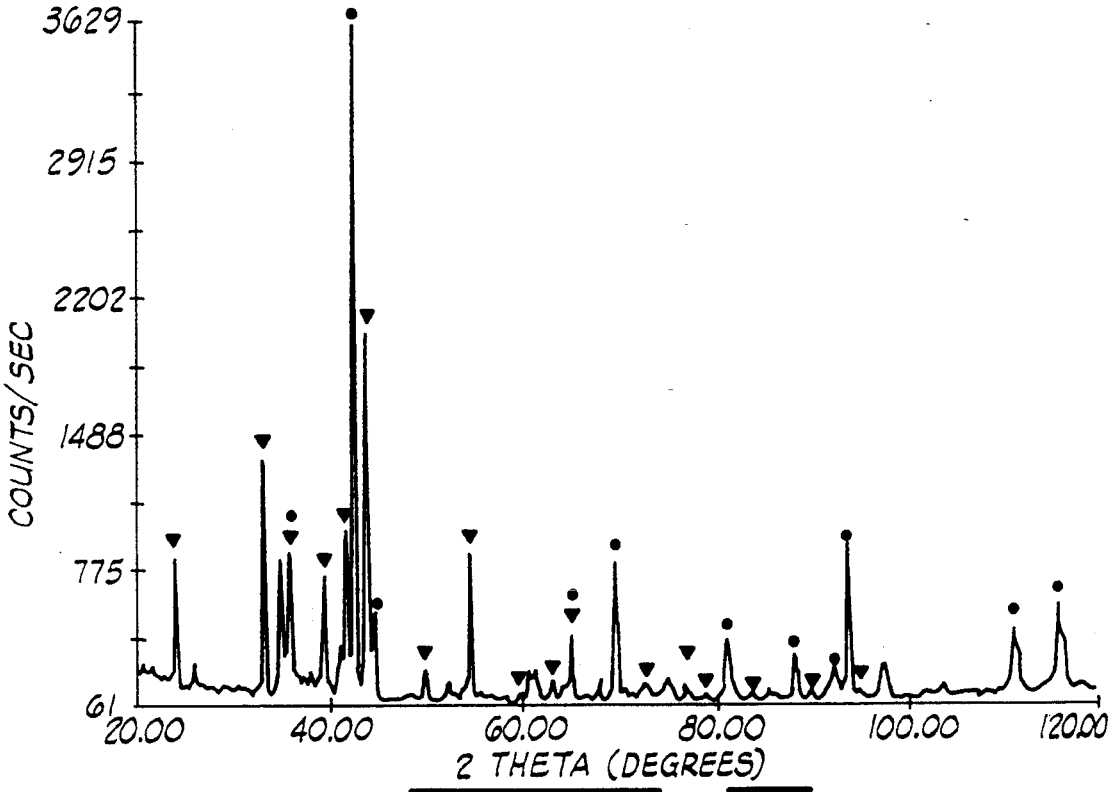
FIG. 7 is an x-ray diffraction profile obtained from a chromium-40 wt. % niobium sample oxidized in air for two hours at 1173K.

X-ray diffraction results for an as-sulfidized Cr-40 wt. % Nb alloy exposed to air at 1173K. for two hours are shown in FIG. 7. Phases present are $Cr_2O_3$ (indicated by solid triangles) and cubic $Cr_2Nb$ ( indicated by solid circles). A few additional weak peaks are partially consistent with a Cr phase and a $Nb_2O_5$ phase. No ternary niobium-chromium oxides were observed. $Cr_2O_3$ diffraction peaks are from the overlying oxidation scale and $Cr_2Nb$ peaks are from the underlying substrate.

Figure 8:
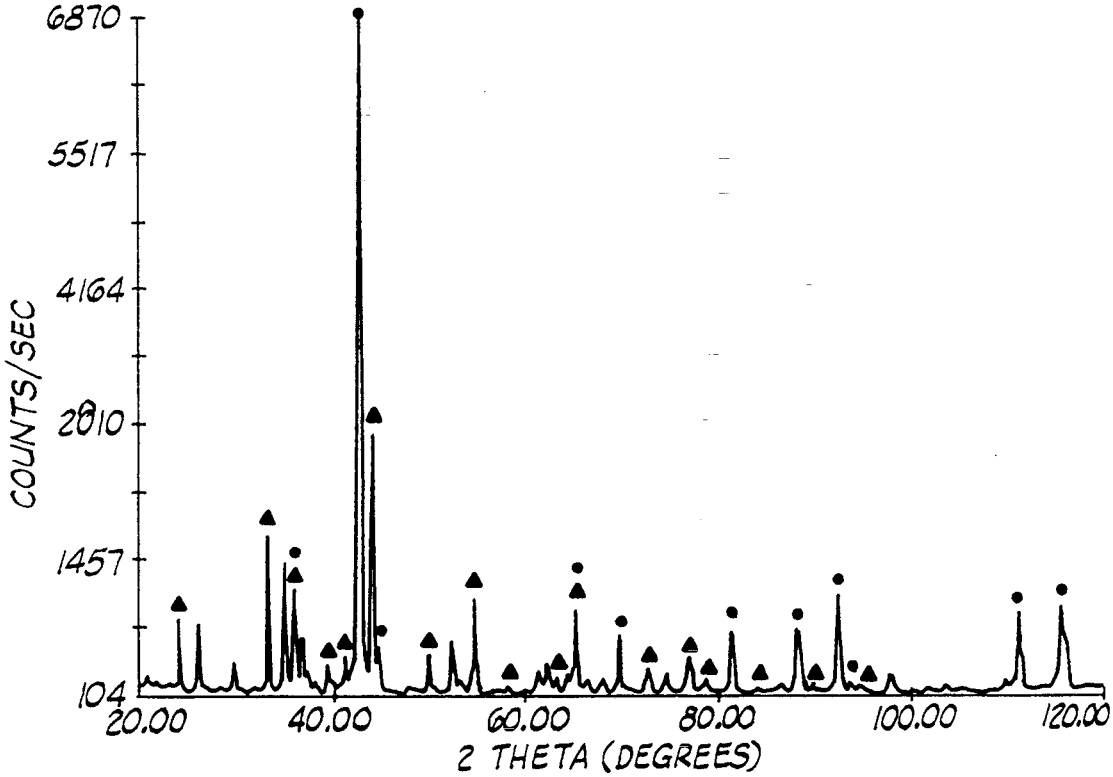
FIG. 8 is a SEM secondary electron image showing the surface morphology of a chromium-40 wt. % niobium sample oxidized for two hours at 1173K. in air.
Figure 8:
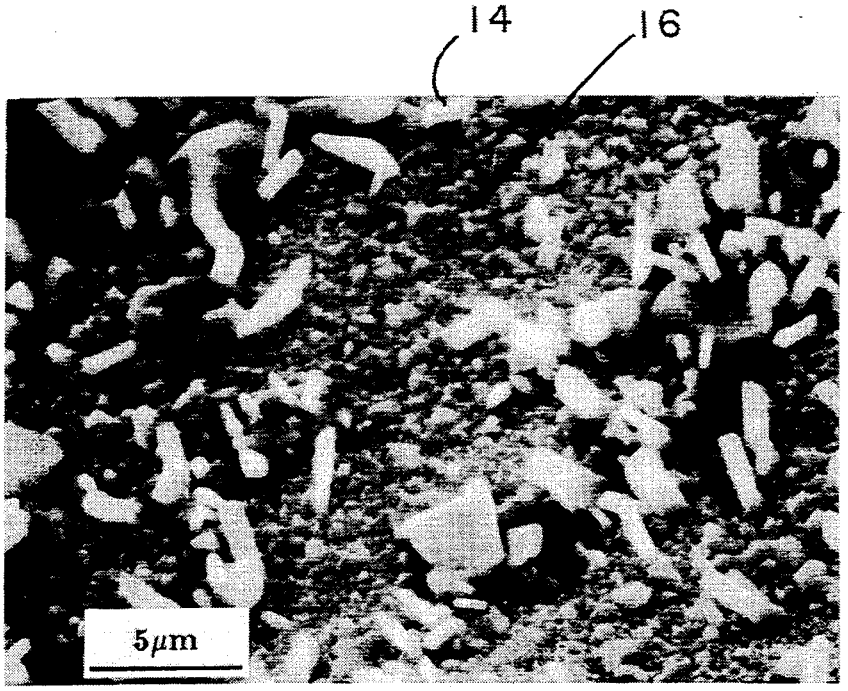
Figure 10:
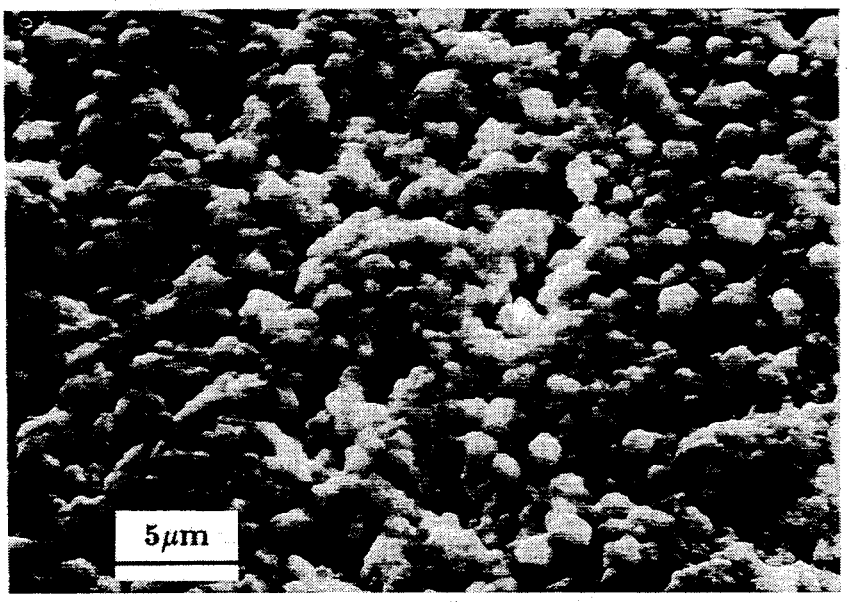
FIG. 10 is a SEM secondary electron image showing the surface morphology of a $Cr_2O_3$ scale formed by a 20 hour oxidation in air at 1173K. of a chromium-40 wt. % niobium sample.

FIG. 8 shows the surface morphology of the already described sample. Some areas show particles of $Nb_2O_5$14 on top of $Cr_2O_3$ scale 16. When the oxidation exposure time was extended to 20 hours, no appreciable differences were observed in the x-ray diffraction pattern, as shown in FIG. 9. Solid circles indicate $Cr_2O_3$-associated peaks and solid triangles indicate $Cr_2Nb$-associated peaks. The morphology of the outer portion of the oxide scale is quite different, however, from that shown in FIG. 9. The morphology of the $Cr_2O_3$ scale is shown in FIG. 10. In all oxidation studies, the Cr-40 wt. % Nb alloy exhibited excellent oxidation resistance by comparison with that of pure Cr, Fe-45 wt. % Cr, and type 310 stainless steel (Fe-20 wt. % Cr-12 wt. % Ni).

One of the most important features of the Cr-40 wt. % Nb alloy is its sulfidation and oxidation behavior at high temperature. The slow sulfide scale growth kinetics shown in FIGS. 5 and 6 indicate that good sulfidation resistance in a sulfidizing atmosphere (without loss of oxidation resistance in an oxidizing atmosphere, i.e. an atmosphere in which an oxide can be formed) is clearly achieved.

Figure 11:
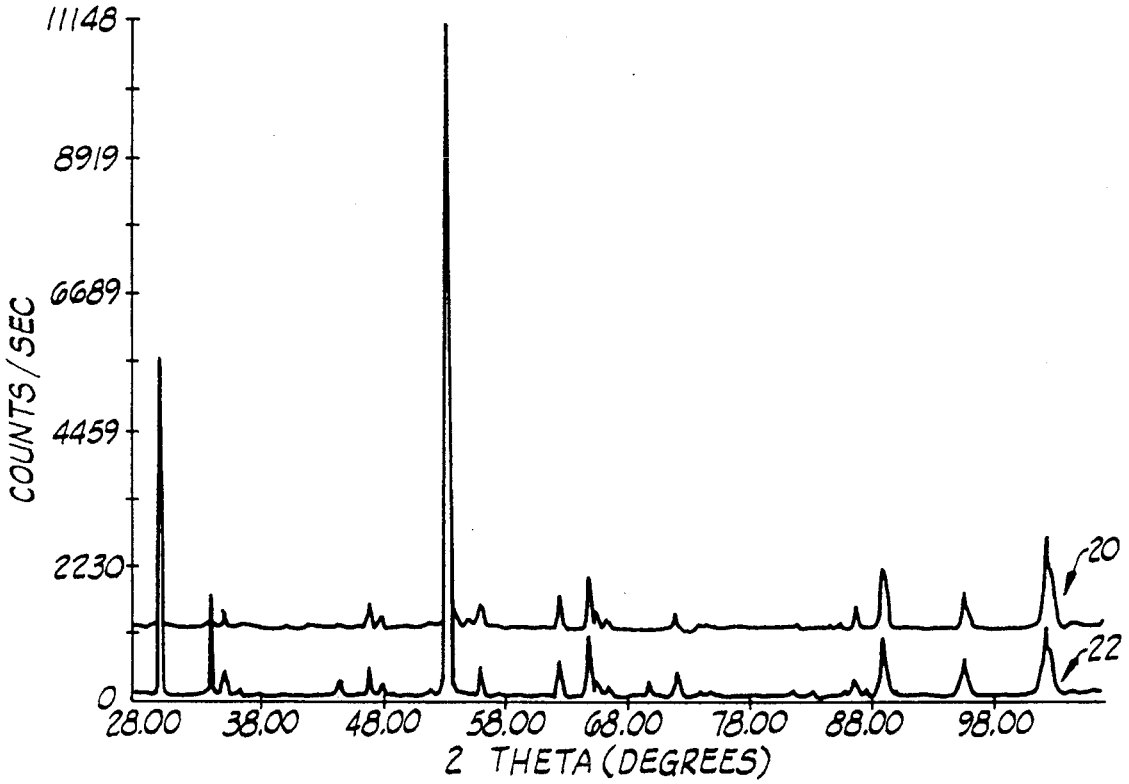
FIG. 11 is an x-ray diffraction profile obtained from two chromium-40 wt. % niobium samples, one subjected to sulfidation at 1173K. and the other to preoxidation followed by sulfidation at 1173K.

The sulfidation scale has been identified as a rhombohedral $Cr_2S_3$ external scale overlying a thin $NbS_2$ inner scale. The corresponding x-ray diffraction profiles are presented in FIG. 11 and confirm the occurrence of the above-mentioned sulfide phase. Profile 20 is for a sample directly sulfidized for 1 hr in $P_{S2}=0.74$ atm at a temperature of 1173K. and profile 22 is for another sample with 2 hr exposure to air followed by 1 hr sulfidation in $P_{S2}=0.74$ atm at 1173K. The rhombohedral $Cr_2S_3$ scale has a very similar morphological structure to that observed in sulfidation of Nb in $H_2$-$H_2S$, and both have $\{10\bar{1}0\}$ planes preferentially parallel to the scale surface. Such morphological structure also indicates that the hexagonal c axis is parallel to the scale/-substrate interface. This scale is evident in the SEM secondary electron images of FIGS. 12, 13, 14 and 15.

Figure 12:
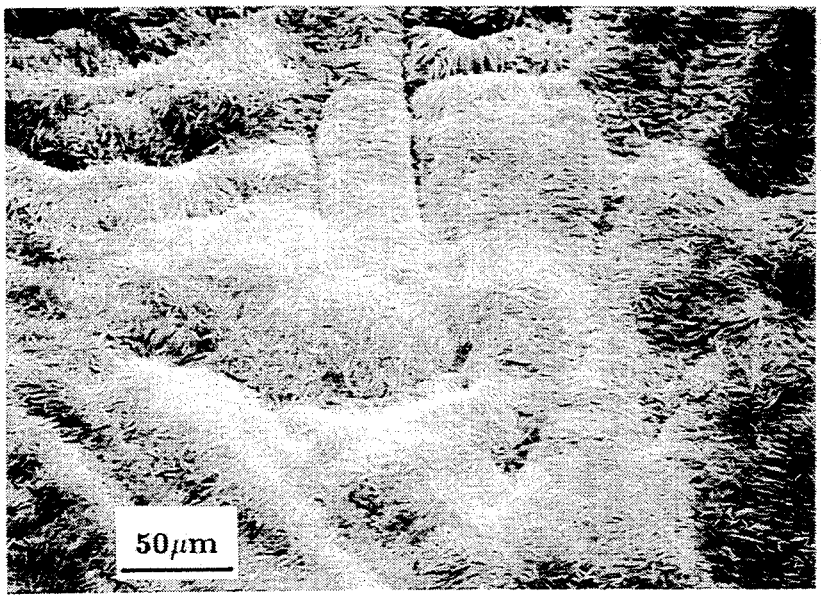
FIG. 12 is a SEM secondary electron image showing the surface morphology of an as-sulfidized chromium-40 wt. % niobium sample sulfidized for 1 hour at 1173K.

FIG. 12 is a SEM secondary electron image showing the surface morphology of an as-sulfidized Cr-40 wt. % Nb sample following a one hour exposure to a sulfur-containing atmosphere having $P_{S2}=0.74$atm at 1173K.

Figure 13:
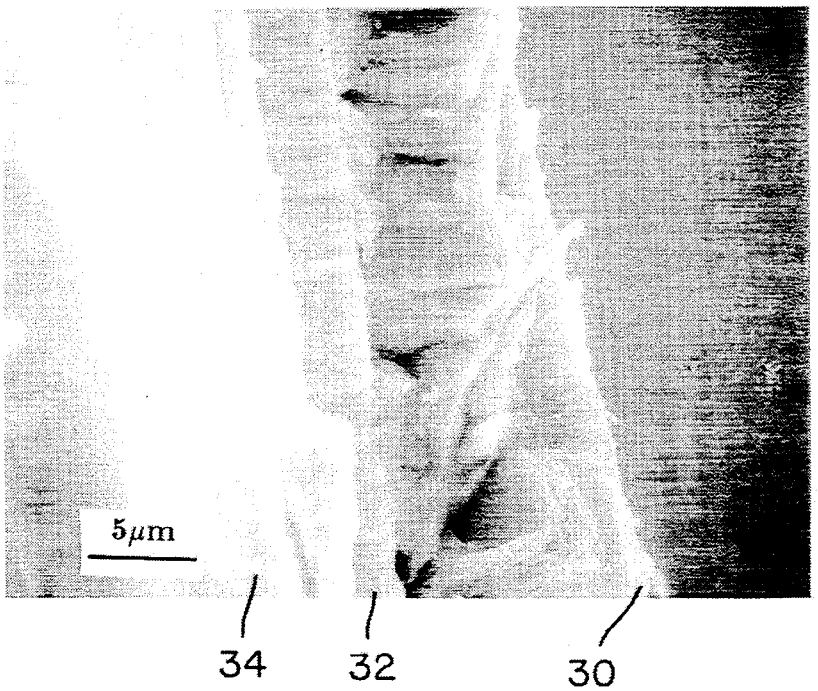
FIG. 13 is a SEM secondary electron image of a fractured cross-section of a chromium-40 wt. % niobium sample showing a duplex sulfidation scale.

FIG. 13 is a SEM secondary electron image of a fracture cross section of the sample whose surface morphology is shown in FIG. 12 showing outer $Cr_2S_3$ scale 30 and inner $NbS_x$ niobium sulfide scale 32 on the surface of chromium-40 wt. % niobium alloy 34.

Figure 14:
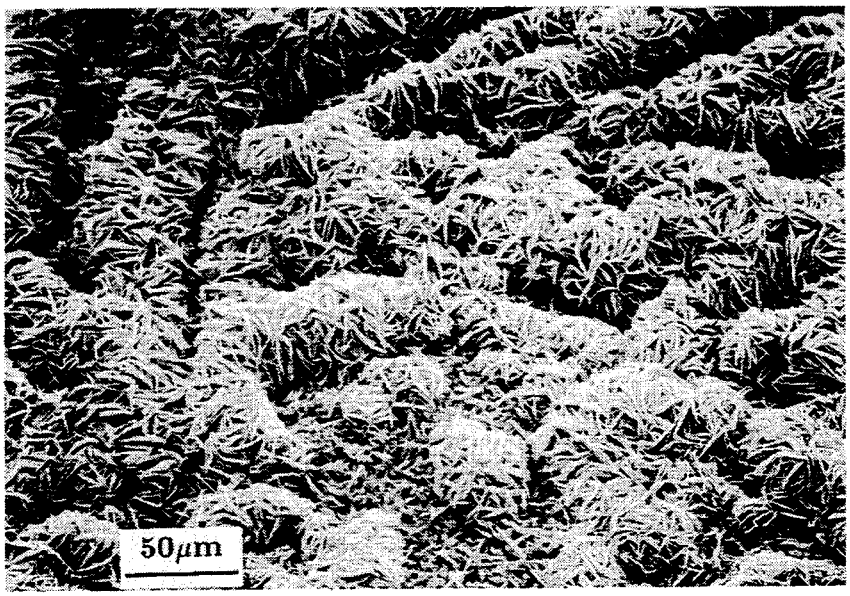
FIG. 14 is a SEM secondary electron image showing the surface morphology of a chromium-40 wt. % niobium sample after a two hour oxidation in air followed by one hour sulfidation in $P_{S2}=0.74$atm at 1173K.

FIG. 14 is a SEM secondary electron image showing the surface morphology of a Cr-40 wt. % Nb sample after a two hour oxidation in air at 1173K. followed by a one hour sulfidation in a sulfur-containing atmosphere having a $P_{S2}=0.74$ atm also at 1173K.

Figure 15:
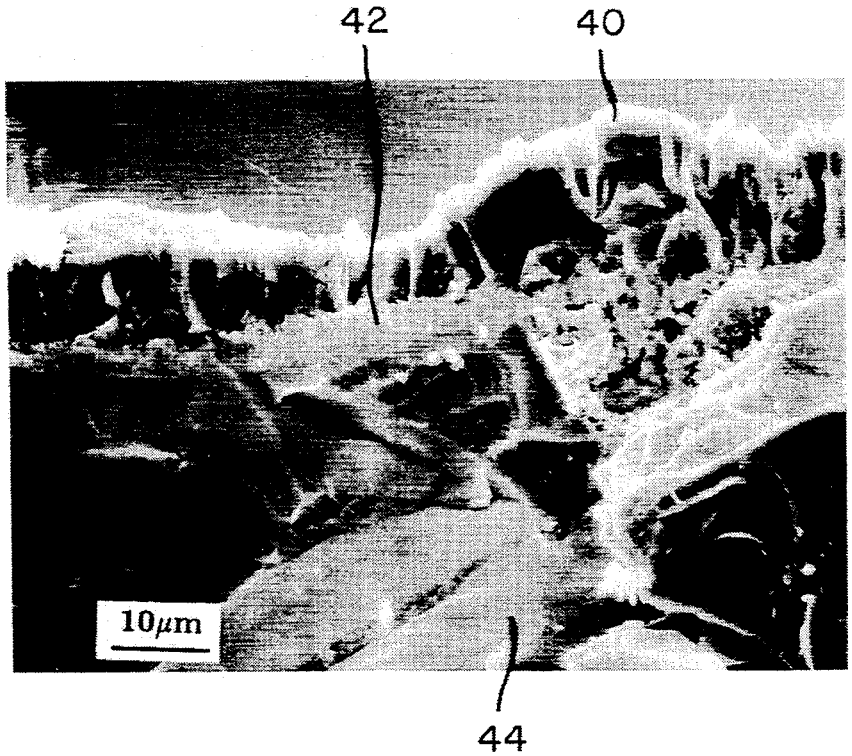
FIG. 15 is a SEM secondary electron image showing a fractured cross-section of a chromium-40 wt. % niobium sample showing formation of continuous but non-uniform outer and inner $Cr_2S_3$ scales.

FIG. 15 is a SEM secondary electron image showing a fracture cross-section of the same sample shown in FIG. 14 and showing $Cr_2S_3$ outer scale 40, and niobium sulfide inner scale 42 on the surface of chromium-40 wt. % niobium alloy substrate 44 and showing that the scales are continuous, although nonuniform.

The present experiments demonstrate the desirable behavior of an alloy containing both Cr and Nb in a high temperature oxidizing and in a high temperature sulfidizing environment. A Cr-Nb containing alloy showed excellent oxidation resistance in an oxidizing atmosphere and satisfactory sulfidation resistance in a sulfidizing atmosphere at 1173K.

The composition investigated, Cr-40 wt. % Nb, lies in that region of the phase stability diagram where two phases co-exist, the ordered $\beta'$ $Cr_2Nb$ phase and body-centered cubic Cr with about 5 wt. % Nb in solution. The alloy contains approximately 90 wt. % of the $\beta'$ phase.

When the Cr-40 wt. % Nb alloy is in oxygen environments, in air for example ($P_{O2}=0.2$ atm), at a temperature of 1173K., Cr selectively oxidizes and $Cr_2O_3$ forms as the principal scale component, which affords oxidation protection. In sulfur environments, for example, $P_{S2}=0.74$ atm, at a temperature of 1173K. a duplex sulfide scale forms, consisting of an outer scale of $Cr_2S_3$ and a continuous inner scale of $NbS_2$, the latter providing sulfidation protection. Although the alloy is two-phase, both phases contain sufficient Cr to result in a continuous $Cr_2O_3$ scale. The $\beta'$ ordered phase is sufficiently continuous to result in formation of the protective $NbS_2$ scale. At 1173K., this alloy exhibits oxidation kinetics similar to those of pure Cr and sulfidation kinetics only slightly inferior to those observed for pure Nb.

By comparison, Fe-Cr containing alloys, for example Fe-45 wt. % Cr, while demonstrating the oxidation resistance of pure Cr through selective oxidation of Cr and formation of a continuous $Cr_2O_3$ scale, sulfidize catastrophically. Even pre-formed $Cr_2O_3$ scales break down in subsequent exposure to sulfur-containing environments. In the Cr-40 wt. % Nb alloy, the sulfidation rate is reduced by a factor of 1000 by comparison with that for sulfidation of pure Cr or of a Fe-45 wt. % Cr alloy. The oxidation rate of the Cr-40 wt. % Nb alloy is $10^5$ times smaller than that of pure Nb and is about equal to the oxidation rate of pure Cr.

The present x-ray diffraction experiments indicate that $Cr_2S_3$ is the only chromium sulfide formed as an external scale for $P_{S2}=0.74$atm.

The $Cr_2S_3$ growth as an outer scale, combined with a niobium sulfide ($NbS_2$, possibly) growth as an inner scale between the alloy substrate and the $Cr_3S$ scale, suggests that $Cr_2S_3$ may grow by the outward migration of Cr. The formation of a continuous inner niobium sulfide scale creates a barrier to the outward diffusion of Cr; consequently, the sulfidation rate of the alloy is more than 1000 times less than that of pure Cr. However, the Applicants do not wish to be limited by the foregoing theory.

The alloy described in the foregoing example combines the element Cr, noted for its high-temperature oxidation resistance, and the element Nb, noted as among the most sulfidation-resistant metallic elements at high temperature. The presence of both elements imparts corrosion resistance in, respectively, oxygen and sulfur-containing environments because their respective scales, $Cr_2O_3$ and $NbS_2$, exhibit very slow diffusion rates for the respective oxygen and sulfur reactants, which must diffuse through the scales for corrosion reactions to continue. Pure Cr in oxygen and pure Nb in sulfur exhibit similar corrosion rates, while the oxidation of Nb and the sulfidation of Cr are enormously more rapid. Alloying the two elements confers the oxidation resistance of Cr and the sulfidation resistance of Nb to the Cr-Nb alloy.

EXAMPLE 2

The following example is provided to show the corrosion behavior of a Cr-40 wt. % Nb alloy under simultaneous oxidation/sulfidation conditions.

A simultaneous oxidation/sulfidation experiment was conducted on a Cr-40 wt. % Nb alloy, prepared as described in EXAMPLE 1, at 1073K. in a $P_{O2}=2.8\times10^{-21}$ atm and $P_{S2}=2.4\times10^{-8}$ atm (designated herein as Gas Mixture A), a gas mixture having a low oxygen pressure and a fairly aggressive sulfur pressure. All experiments were conducted using continuous thermogravimetric measurement with a Cahn Model 1000 microbalance and flowing gas entering the bottom of a vertical furnace. An appropriate flow of a $H_2$-$H_2S$ or $H_2$-$H_2O$-$H_2S$ gas mixture was used to obtain the desired partial pressures of $S_2$ and $O_2$. Corrosion experiments were run for 20 hours except for some shorter runs to evaluate initial or transient stages. Kinetic data were obtained from the TGA curves. Parabolic and linear rates found in this study are given in Table 2. Glancing Angle (0.5°) X-Ray Diffraction (GAXRD) and scanning electron microscopy were used for scale identification and to establish the surface morphology.

TABLE 2

| Gas Mix/Temp | Calculated corrosion rates for this study. Parabolic rates in units of $kg^2/m^4s$ Linear rates(*) in units of $kg/m^2s$ | | |
|---|---|---|---|
| | Cr | Nb | Cr-40 wt. % Nb Alloy |
| A 1073K | $1.8 \times 10^{-6}$ | $2.5 \times 10^{-9}$ | $1.0 \times 10^{-7}$ |
| B 1173K | $2.0 \times 10^{-10}$ | $1.0 \times 10^{-6*}$ | $10 \times 10^{-9}$ |

Figure 16:
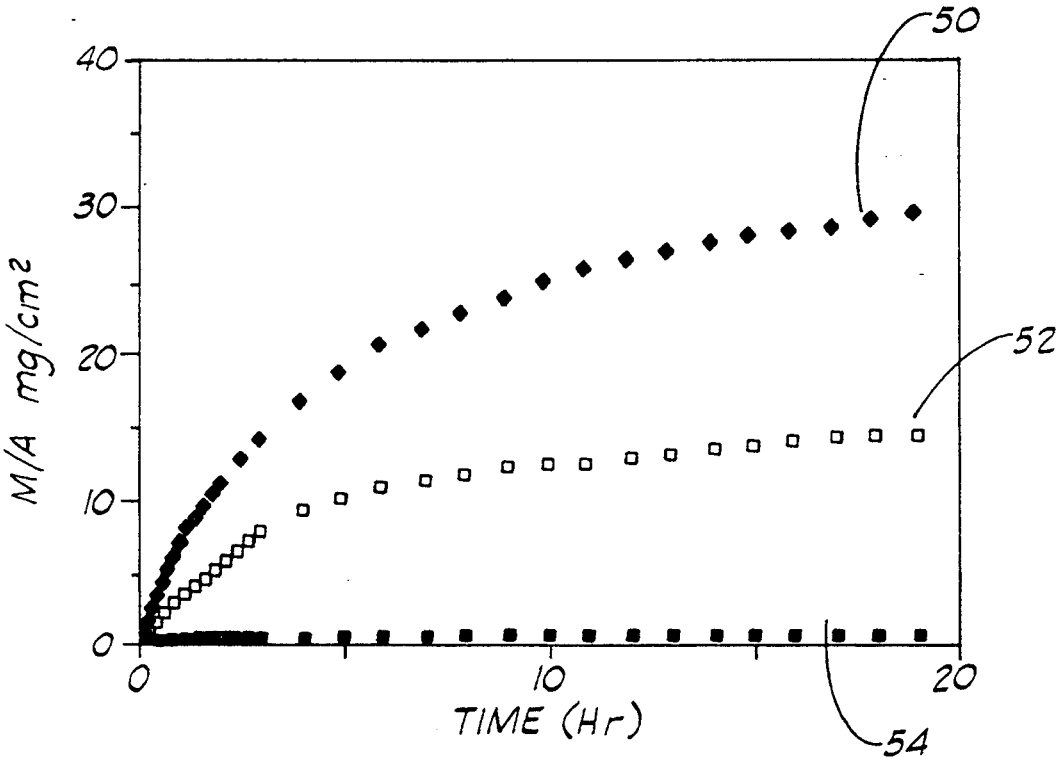
FIG. 16 is a graph showing weight gain as a function of time for Cr, Nb, and a Cr-40 wt. % Nb alloy exposed to $P_{O2}=2.8\times10^{-21}$ atm and $P_{S2}=2.4\times10^{-8}$ atm at 1073K. for 20 hours.

TGA results obtained for a Cr-40 wt. % Nb alloy exposed to Gas Mixture A are shown in FIG. 16 and the Cr-40 wt. % Nb alloy, curve 52, is seen to exhibit a parabolic corrosion rate intermediate between that of pure Cr, curve 50, and that of pure Nb, curve 54.

GAXRD showed the scale composition to be a mix of chromia and chromium sulfides. The scale on Cr was also a mix of oxides and sulfides , suggesting that Gas Mixture A was an atmosphere near a kinetic boundary, and had a macroscopic surface roughness in the shape of blades or large needles. The scale on the niobium, which was the slowest growing, consisted of $NbO_2$ and not of $NbS_2$ or any other niobium sulfide.

SEM examination showed a rather dense scale on the Cr-40 wt. % Nb alloy, with no spallation but with some evidence of cracks. Small particles of what may be $Nb_2O_5$ were evident on top of the scale. Comparison with pure sulfidation of pure Nb, which was carried out at a higher $P_{S2}$ of $1.1\times10^{-7}$ atm and even then did not form $NbS_2$, suggests that the sulfur pressure may not have been high enough in Gas Mixture A to form a protective $NbS_2$ scale on Nb.

Figure 17:
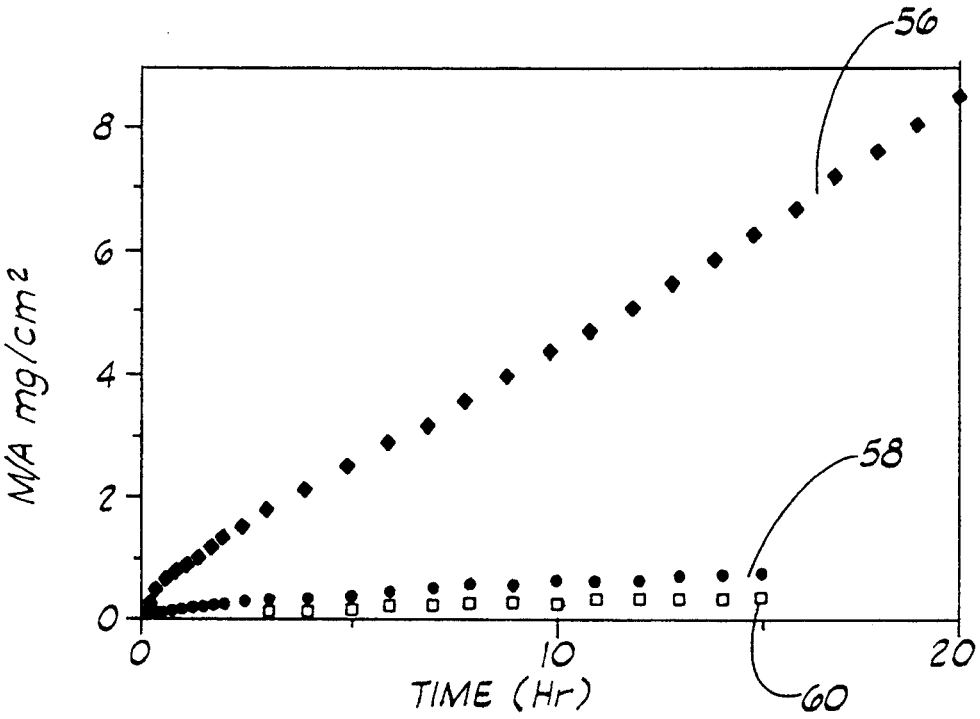
FIG. 17 is a graph showing weight gain as a function of time for Cr, Nb and a Cr-40wt %Nb alloy exposed to $P_{O2}=1.0\times10^{-18}$ atm and $P_{S2}=1.0\times10^{-8}$ atm at 1173K. for 20 hours.

The Cr-40 wt. % Nb alloy displayed better corrosion resistance at 1173K. when exposed to Gas Mixture B ($P_{O2}=1.0\times10^{-18}$ atm and $P_{S2}=1.0\times10^{-8}$ atm) as can be seen in FIG. 17. In FIG. 17, curve 56 is for pure Nb, curve 58 is for the Cr-40 wt. % Nb alloy and curve 60 is for pure Cr. It is noted that the foregoing 1173K. temperature and Gas Mixture B composition are fairly typical of conditions encountered in coal gasification processes.

GAXRD showed the scale on the alloy to be chromia. No other peaks indicating sulfides were found. On this basis, the alloy is considered to behave very similarly to pure Cr. Pure Nb had a linear oxidation rate much higher than that of the Cr-40 wt. % Nb alloy or than that of pure Cr and with a scale consisting of $NbO_2$ with small amounts of $Nb_2O_5$.

EXAMPLE 3

The following example is provided to show how an oxidation and sulfidation resistant article including an alloy containing chromium and niobium can be prepared according to the method of the invention.

An Fe-22 wt. % Cr-40 wt. % Nb alloy rod was prepared by hot isostatic pressing ball-milled powders. Starting powders of pure Fe, Cr and Nb (99.99% purity) with particle size <5 μm were lightly mixed, placed in a vibrating ball mill with stainless-steel balls, and dry-milled for 4 hours in air. The milled powder was tightly packed into a 25-mm diameter thin-walled stainless steel tube and the tube ends sealed under vacuum. The sealed tube was heated to 1673K. in an environment of high-pressure argon gas for 4 hours, until the tube had undergone an approximately 50% reduction in diameter. The tube was allowed to air cool, then machined away from the resulting alloy inside.

A similar process can be employed to produce articles of more complex shape and function by one skilled in the art of hot-pressing or hot isostatic pressing of powder preforms.

What is claimed is:

1. A method for preventing oxidation and/or sulfidation of an article, the improvement comprising forming said article from an alloy including at least two phases and consisting essentially of in the range of from about 17 wt. % to about 72 wt. % chromium and in the range of from about 83 wt. % to about 28 wt. % niobium.

2. The method of claim 1 wherein said alloy is further characterized by simultaneous oxidation and sulfidation resistance.

3. The method of claim 1 wherein said alloy contains an amount of chromium sufficient to form a protective chromium-containing scale when said alloy is exposed to said oxygen-containing atmosphere and an amount of niobium sufficient to form a protective Nb-containing scale when said alloy is exposed to said sulfur-containing atmosphere.

4. The method of claim 1 wherein said alloy is further characterized by a chromium concentration and by a niobium concentration and said chromium concentration is the range of from about 17 wt. % to about 72 wt. % and more in the range of from about 38 wt. % to about 60 wt. % and said niobium concentration is in the range of from about 40 wt. % to about 62 wt. %.

5. The method of claim 1 wherein the step of forming said article further comprises providing a substrate and coating said substrate with said alloy including at least two phases.

6. The method of claim 3 wherein said oxygen-containing atmosphere is characterized by a temperature in 1173K. the range of from about 1073K. to about

7. The method of claim 3 wherein said oxygen-containing atmosphere is an oxidizing atmosphere further characterized by an oxygen concentration in the range of from about 1 atm to the concentration of oxygen in air at 1 atm, said sulfur-containing atmosphere is a sulfidizing atmosphere characterized by a sulfur concentration of in the range of from about 1 atm sulfur to about 0.8 atm sulfur.

8. The method of claim 3 wherein said oxygen-containing atmosphere is a mixture of both sulfur and oxygen characterized by a mixture oxygen concentration and by a mixture sulfur concentration and said mixture oxygen concentration is in the range of from about $1\times10^{-21}$ arm to about $1\times10^{-10}$ atm and said mixture sulfur concentration is in the range of from about $1\times10^{-10}$ atm to about 1 atm, more preferably in the range of from about $1\times10^{-10}$ atm to about $1\times10^{-5}$ arm and host preferably in the range of from about $1\times10^{-10}$ atm to about $1\times10^{-5}$ atm.

9. The method of claim 4 wherein said alloy consists essentially of 40 wt. % niobium and 60 wt. % chromium.

10. The method of claim 9 wherein said alloy includes about 90 wt. % of a first, ordered $\beta'$ $Cr_2Nb$ phase and about 10 wt. % of a second, body-centered cubic chromium with niobium in solution phase.

* * * * *

UNITED STATES PATENT AND TRADEMARK OFFICE

CERTIFICATE OF CORRECTION

PATENT NO. : 5,368,813

DATED : November 29, 1994

INVENTOR(S) : Linn W. Hobbs et al

It is certified that error appears in the above-indentified patent and that said Letters Patent is hereby corrected as shown below:

Column 4, line 58, after "$1x10^{-10}$", insert -- atm, --.

Column 6, line 13, change "1073-K-1473K." to —1073K.- 1473K.—.

Column 12, claim 4, line 30, after "is", delete "the range of from about 17 wt.% to about 72 wt.".

Column 12, claim 4, line 31, at the beginning of the line, delete "% and more".

Column 12, claim 6, line 40, at the beginning of the line, delete 1173K.".

Column 12, claim 6, line 40 after "about", insert —1173K.—(second occurrence).

Column 12, claim 8, line 58, change "host' to —most—.

Column 12, claim 8, line 59, change "$1x10^{-5}$" to -- $1x10^{-8}$ --.

Column 12, claim 8, line 57, change "arm" to —atm—.

Signed and Sealed this

Seventh Day of February, 1995

*Attest:*

*Attesting Officer*

BRUCE LEHMAN

*Commissioner of Patents and Trademarks*